US010790614B1

(12) United States Patent
Chen et al.

(10) Patent No.: US 10,790,614 B1
(45) Date of Patent: Sep. 29, 2020

(54) PLUG CONNECTOR WITH MOVABLE UNLOCKING STRUCTURE AND PLUG CONNECTOR ASSEMBLY INCLUDING THE SAME

(71) Applicant: Amphenol East Asia Limited Taiwan Branch (H.K.), Taoyuan (TW)

(72) Inventors: Chien-Ming Chen, Taoyuan (TW); Szu-Ting Liao, Taoyuan (TW)

(73) Assignee: AMPHENOL EAST ASIA LIMITED TAIWAN BRANCH (H.K.), Taoyuan (TW)

( * ) Notice: Subject to any disclaimer, the term of this patent is extended or adjusted under 35 U.S.C. 154(b) by 0 days.

(21) Appl. No.: 16/601,751

(22) Filed: Oct. 15, 2019

(30) Foreign Application Priority Data

May 24, 2019 (TW) ..... 108118085 A

(51) Int. Cl.
*H01R 13/635* (2006.01)
*H01R 13/627* (2006.01)

(52) U.S. Cl.
CPC ..... *H01R 13/635* (2013.01); *H01R 13/6273* (2013.01)

(58) Field of Classification Search
CPC . H01R 13/633; H01R 13/6335; H01R 13/635
See application file for complete search history.

(56) References Cited

U.S. PATENT DOCUMENTS 4,858,309 A * 8/1989 Korsunsky ..... H01R 12/7005 29/764
5,613,870 A * 3/1997 Traver, Jr. ..... H01R 13/6273 439/352
5,762,513 A * 6/1998 Stine ..... H01R 13/6273 439/358
6,179,642 B1 * 1/2001 Hwang ..... H01R 13/5804 439/358
6,202,295 B1 * 3/2001 Easter ..... H01R 43/205 29/762
6,556,445 B2 * 4/2003 Medina ..... G02B 6/4246 349/160
6,648,665 B1 * 11/2003 Wu ..... H01R 13/6275 439/352
6,702,603 B2 * 3/2004 Wu ..... H01R 13/6275 439/352
6,746,158 B2 * 6/2004 Merrick ..... G02B 6/4201 24/605

(Continued)

*Primary Examiner* — Ross N Gushi
(74) *Attorney, Agent, or Firm* — Bacon & Thomas, PLLC

(57) ABSTRACT

A plug connector has a movable unlocking structure, and a plug connector assembly includes the plug connector and two slidable locking portions to be engaged with the left and right surfaces of the plug connector respectively. The rear surface of the plug connector has two first locking units, at least one of the plug connector and the slidable locking portions has an inclined contact surface, and when the plug connector is connected to a socket connector and the slidable locking portions are engaged with the plug connector and move toward the top side of the plug connector, the rear surface of the plug connector is pushed outward with the assistance of the inclined contact surface, unlocking the first locking units from the engaging portions on the socket connector respectively.

30 Claims, 8 Drawing Sheets

(56) References Cited

U.S. PATENT DOCUMENTS 6,851,867 B2 * 2/2005 Pang ..... G02B 6/3825 385/134
6,916,196 B2 * 7/2005 Long ..... H01R 13/627 439/352
7,204,712 B2 * 4/2007 Schwiebert ..... G02B 6/4201 439/352
7,255,484 B2 * 8/2007 Walker, Jr. ..... G02B 6/4246 385/53
7,416,433 B1 * 8/2008 Wu ..... G02B 6/4246 439/160
7,422,457 B1 * 9/2008 Wu ..... G02B 6/4201 439/258
7,445,484 B2 * 11/2008 Wu ..... H01R 13/6584 439/352
7,458,144 B2 * 12/2008 Barina ..... H01R 13/6335 29/426.5
7,473,124 B1 * 1/2009 Briant ..... H01R 13/6275 439/352
7,477,825 B2 * 1/2009 Walker ..... G02B 6/4246 385/134
7,497,705 B2 * 3/2009 Larson ..... H01R 13/6397 439/133
7,513,698 B2 * 4/2009 Andersson ..... G02B 6/4292 385/88
7,690,939 B2 * 4/2010 Wu ..... H01R 9/032 439/160
8,308,377 B2 * 11/2012 Yi ..... G02B 6/4261 385/134
8,506,172 B2 * 8/2013 Meadowcroft ..... G02B 6/4261 385/147
8,537,558 B2 * 9/2013 Su ..... H01R 9/032 361/740
8,556,646 B2 * 10/2013 Kappla ..... G02B 6/4246 439/352
9,146,366 B2 * 9/2015 Koutrokois ..... G02B 6/4246
9,927,585 B1 * 3/2018 Shih ..... G02B 6/4257
10,230,207 B2 * 3/2019 Krupp ..... H01R 13/6335
2002/0115331 A1 * 8/2002 Ho ..... H01R 13/20 439/346
2002/0142649 A1 * 10/2002 Baugh ..... H01R 13/633 439/532
2003/0207606 A1 * 11/2003 Ho ..... H01R 13/20 439/346
2006/0194469 A1 * 8/2006 Miyakawa ..... H01R 13/633 439/357
2007/0243749 A1 * 10/2007 Wu ..... H01R 13/6596 439/352
2008/0031577 A1 * 2/2008 Walker ..... G02B 6/4246 385/92
2010/0291787 A1 * 11/2010 Kuo ..... H01R 13/639 439/352
2011/0318952 A1 * 12/2011 Huang ..... H01R 13/633 439/352
2012/0251049 A1 * 10/2012 Meadowcroft ..... G02B 6/4261 385/53
2019/0319401 A1 * 10/2019 Yang ..... H01R 13/6273
2019/0363486 A1 * 11/2019 Ochiai ..... H01R 13/627
2020/0076132 A1 * 3/2020 Yang ..... H01R 12/7064

* cited by examiner

PLUG CONNECTOR WITH MOVABLE UNLOCKING STRUCTURE AND PLUG CONNECTOR ASSEMBLY INCLUDING THE SAME

FIELD OF THE INVENTION

The present disclosure relates to a plug connector and a plug connector assembly including a plug connector. More particularly, the present disclosure relates to a plug connector assembly in which either the plug housing or the slidable locking portions are provided with inclined contact surfaces so that, once the plug connector is connected to a socket connector and the slidable locking portions are engaged with the plug connector, the slidable locking portions can be moved along the inclined contact surfaces respectively to push the rear surface of the plug housing outward, thereby unlocking the plug connector from the socket connector.

BACKGROUND OF THE. INVENTION

Due to the advancement of electronic and communication technologies, electronic devices are nowadays equipped with a variety of functions and have become indispensable tools in our daily lives. Some notable examples of such devices are mobile phones, which allow people in different parts of the world to communicate with one another; powerbanks, which can be carried around to supply electricity to mobile phones continuously; portable audio players, which satisfy our need to listen to music anywhere anytime; and personal computers, which are depended upon to help with all sorts of things.

In order to receive electronic signals and electric power from the outside, an electronic device (e.g., be it a smartphone, tablet computer, desktop computer, laptop computer, or digital camera) must be provided with a connector on the device body. As used herein, the term "connector" refers to a connecting device for use with electronic signals and/or electric power and to its accessories. Connectors can be viewed as bridges for all kinds of signals, and their quality affects the reliability of signal and/or current transmission and is therefore crucial to the operation of electronic devices. Connectors also allow a plurality of electronic devices to be connected as a complete system and to transmit electronic signals and/or electric power to one another. In fact, therefore, connectors are essential to electronic devices in that the latter cannot carry out their predetermined functions without the former.

Connector structures vary with their applications and installation locations in order to adapt to and meet user needs. For example, as the concept and use of intelligent vehicles become increasingly prevalent, the demand for automotive connectors is rising substantially. One of the challenges facing automotive connectors is that two connected automotive connectors in a vehicle may eventually come loose, if not separate, from each other as a result of the vibrations generated by the vehicle running on bumpy roads. To ensure secure connection, therefore, an automotive connector is generally provided with a locking structure, which, however, not only adds to the difficulty of design, but also requires additional locking and unlocking operations.

The issue to be addressed by the present disclosure is to provide an effective solution to the aforesaid problem so that a connector not only stays secure in place during use, but also can be unlocked with ease.

BRIEF SUMMARY OF THE INVENTION

As the general structure of the conventional connectors still leaves something to be desired in terms of use, the inventor of the present disclosure incorporated years of practical experience in the design, processing, and manufacture of various signal and power connectors and the spirit of continued perfection into an extensive research and experiment and finally succeeded in developing a plug connector with a movable unlocking structure and a plug connector assembly having a plug connector and a movable unlocking structure. The present disclosure is intended to increase the physical stability of two connected connectors but allow the connectors to be easily unlocked from each other so as to provide better user experience.

One objective of the present disclosure is to provide a plug connector having a movable unlocking structure. The plug connector includes a plug housing, an insulating plug body, and a plurality of metal plug terminals. The bottom side of the plug housing is formed with a plug insertion opening, the plug insertion opening is recessed into the plug housing to form a plug assembly space extending into the plug housing from the plug insertion opening, and the plug assembly space is adapted for accommodating the insulating plug body. The rear surface of the plug housing is provided with two first locking units adjacent to the plug insertion opening. When the plug connector is connected to a socket connector, two engaging portions of the socket connector are engaged with the first locking units respectively. The metal plug terminals are arranged on the insulating plug body. The insulating plug body is mounted in the plug assembly space. The movable unlocking structure includes two inclined contact surfaces on an inner wall of the plug housing, adjacent to the first locking units respectively, corresponding respectively to two slidable locking portions and adapted for the slidable locking portions to move thereon, and is movable outward to disengage the first locking units from the engaging portions and bring the first locking units into an unlocked state. When the plug connector and the socket connector are connected together and two slidable locking portions are engaged with the left and right surfaces of the plug connector respectively, the two slidable locking portions can be moved toward the top side of the plug housing and consequently moved along the first inclined contact surfaces respectively, with the goal being to push the rear surface of the plug housing outward so that each first locking unit is separated, or disengaged, from the corresponding engaging portion and enters the unlocked state. That is, when the plug connector and the socket connector are connected, a left surface and a right surface of the plug housing are engaged with the slidable locking portions respectively, and the slidable locking portions move toward a top side of the plug housing along the inclined contact surfaces, the rear surface of the plug housing is pushed outward by the slidable locking portions to disengage the first locking units from the engaging portions and bring the first locking units into an unlocked state.

Another objective of the present disclosure is to provide a plug connector assembly having a movable unlocking structure. The plug connector assembly includes a plug connector, and the movable unlocking structure includes two slidable locking portions. The plug connector has similar structural features stated above. The two slidable locking portions are configured to be engaged with the left and right surfaces of the plug connector respectively. At least one of the plug housing and the two slidable locking portions has a wall provided with an inclined contact surface. When the plug connector and the socket connector are connected together and the two slidable locking portions are engaged with the plug connector, the two slidable locking portions can be moved toward the top side of the plug housing so that, thanks to the configuration of the inclined contact surface, the rear surface of the plug housing will be pushed outward to separate, or disengage, each first locking unit from the corresponding engaging portion and thereby bring the first locking units into the unlocked state. That is, when the plug connector and the socket connector are connected and the two slidable locking portions are engaged with the plug housing and move toward a top side of the plug housing, the two slidable locking portions push the rear surface of the plug housing outward via the first inclined contact surfaces to separate the first locking units from the engaging portions respectively and bring the first locking units into an unlocked state.

BRIEF DESCRIPTION OF THE SEVERAL VIEWS OF THE DRAWINGS

The objectives, technical features, and effects of the present disclosure can be better understood by referring to the following detailed description of some illustrative embodiments in conjunction with the accompanying drawings, in which.

DETAILED DESCRIPTION OF THE INVENTION

Figure 1:
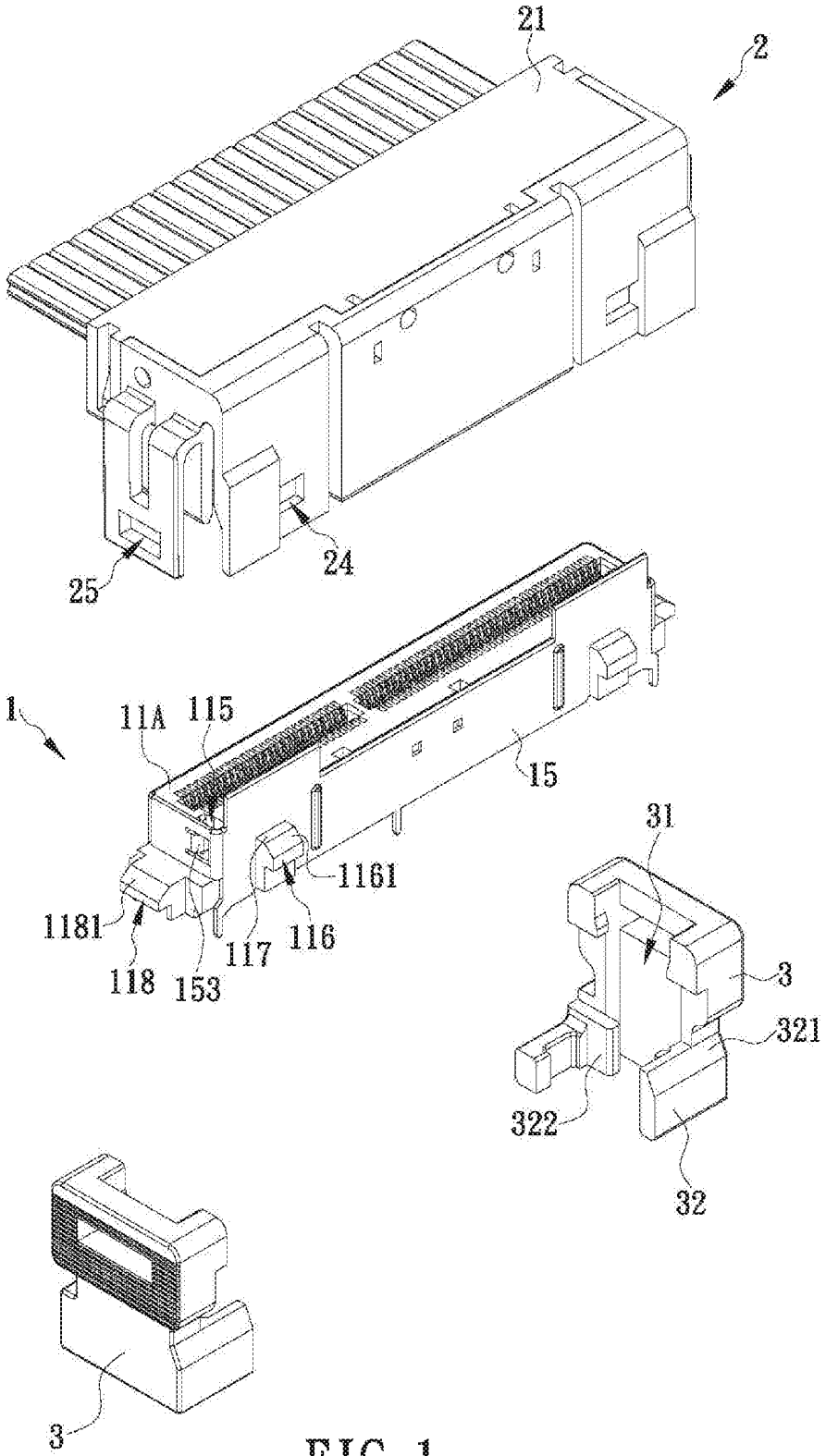
FIG. 1 is an exploded perspective view of a plug connector assembly according to the present disclosure and a socket connector.
Figure 2:
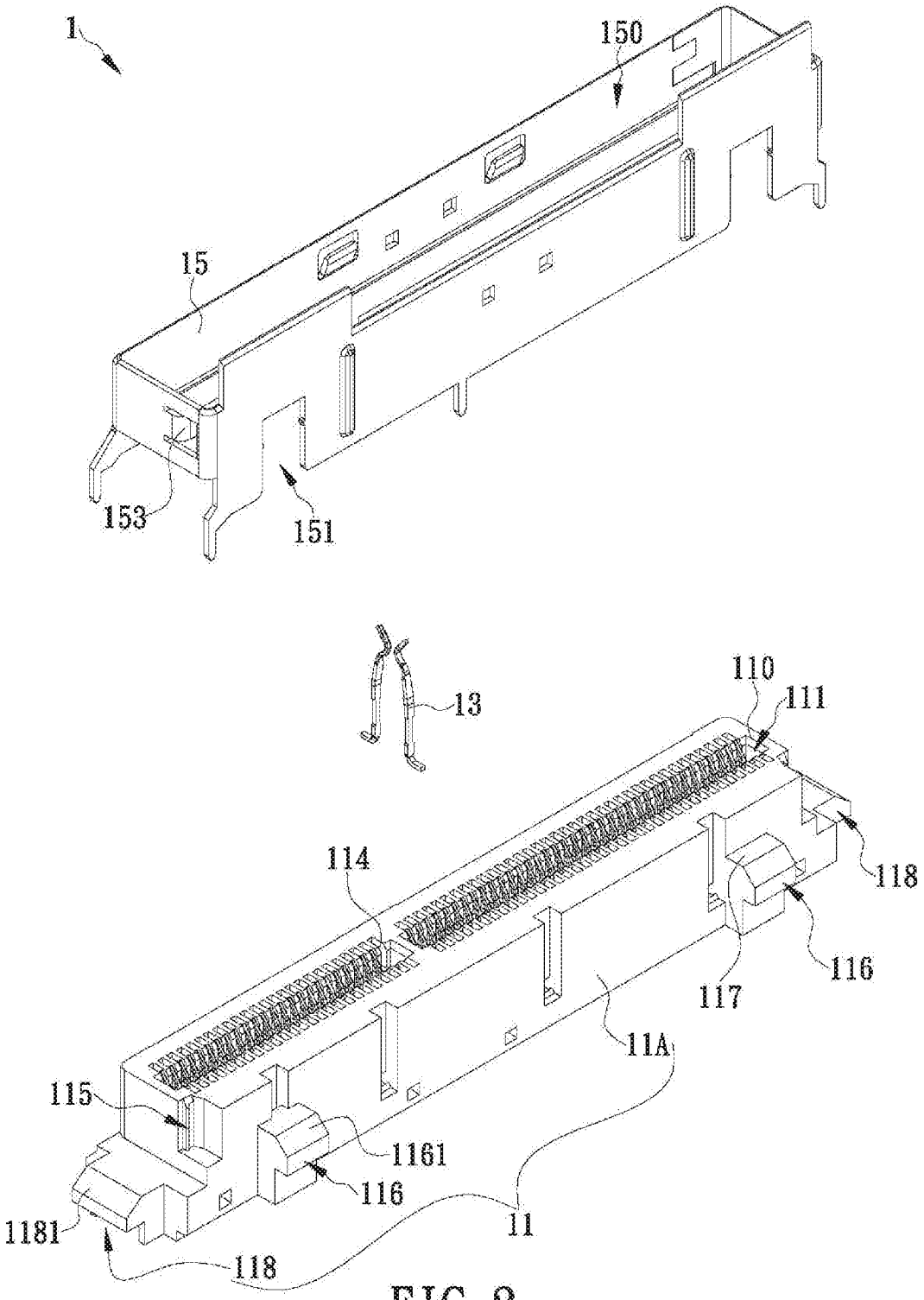
FIG. 2 is an exploded perspective of the socket connector in FIG. 1.

The present disclosure discloses a plug connector with a movable unlocking structure and a plug connector assembly including a movable unlocking structure. Referring to FIG. 1, the plug connector assembly according to an embodiment of the present disclosure at least includes a plug connector 2 and two slidable locking portions 3 and is configured for use with, or more specifically to connect with a socket connector 1. It should be pointed out that the movable unlocking structure in the present disclosure is designed for the locking structures between the plug connector 2 and the socket connector 1 and is intended to provide ease of unlocking. The following description, therefore, begins with the locking structure of the socket connector 1. Referring to FIG. 1 and FIG. 2, the socket connector 1 includes an insulating socket body 11, a plurality of metal socket terminals 13, and a socket housing 15. To facilitate description, the top side of each component described herein is defined as facing the top edge of FIG. 1, the bottom side of each component is defined as facing the bottom edge of FIG. 1, the left surface of each component is defined as facing the lower left corner of FIG. 1, the right surface of each component is defined as facing the upper right corner of FIG. 1, the front side of each component is defined as facing the upper left corner of FIG. 1, and the rear surface of each component is defined as facing the lower right corner of FIG. 1. Please note that the configuration of each component of the plug connector assembly of the present disclosure is not limited to that depicted in FIG. 1. A manufacturer may adjust the configuration of each component according to product requirements, provided that the plug connector assembly has the structure and functions disclosed in the following embodiments.

In the embodiment shown in FIG. 1 and FIG. 2, the insulating socket body 11 is composed at least of a socket body portion 11A, at least one engaging portion 116, and two fastening portions 118. The top side of the socket body portion 11A is formed with a socket insertion opening 110, in which a socket receiving space 111 is provided. The socket receiving space 111 is in communication with the socket insertion opening 110. The insulating socket body 11 has two opposite inner sides each provided with a plurality of terminal grooves 114. The socket insertion opening 110, the terminal grooves 114, and the socket receiving space 111 communicate with one another. In other embodiments of the present disclosure, the socket body portion 11A may dispense with the terminal grooves 114 or be additionally provided therein with a tongue plate in which the terminal grooves 114 are formed, in order to adapt the structure of the insulating socket body 11 to various types of connectors.

With continued reference to FIG. 1 and FIG. 2, two engaging portions 116 are provided on and protrude outward of the rear surface of the socket body portion 11A and are adjacent to the bottom side of the socket body portion 11A. The two fastening portions 118 are provided on and protrude outward of the left and right surfaces of the socket body portion 11A respectively and are also adjacent to the bottom side of the socket body portion 11A. The engaging portions 116 are part of a first locking structure while the fastening portions 118 are part of a second locking structure. The locking methods of those locking structures will be described further below. In other embodiments of the present disclosure, however, it is feasible for the engaging portions 116 to exist without the fastening portions 118; that is to say, a plug connector assembly according to the present disclosure may include only the first locking structure and the corresponding unlocking structure described below.

As shown in FIG. 1 and FIG. 2, the metal socket terminals 13 are fixedly provided in the insulating socket body 11 and are spaced apart from one another. The metal socket terminals 13 in this embodiment may be at least one of signal terminals, ground terminals, and power terminals, and are fitted in the terminal grooves 114 respectively such that each metal socket terminal 13 has a top end exposed through the socket receiving space 111 (see FIG. 2) and the opposite end extending out of the bottom end of the insulating socket body 11 (see FIG. 3) in order to be connected (e.g., soldered) to a circuit board or other component.

With continued reference to FIG. 1 and FIG. 2, the socket housing 15 is formed by bending at least one metal plate. In this embodiment, the socket housing 15 has a rectangular cross section such that a vertically throughgoing socket assembly space 150 is formed in and surrounded by the socket housing 15. The socket housing 15, however, is not necessarily shaped as shown in FIG. 2, provided that the socket housing 15 has an at least U-shaped cross section capable of forming the vertically throughgoing socket assembly space 150. The insulating socket body 11 is configured to extend into the socket assembly space 150 and be fixed in the socket housing 15 in order for the socket housing 15 to shield the metal socket terminals 13 from electromagnetic interference (EMI), to serve as a grounding path for the metal socket terminals 13, and to protect the insulating socket body 11. Once the insulating socket body 11 and the socket housing 15 are put together in the foregoing manner, both the engaging portions 116 and the fastening portions 118 are outside the socket assembly space 150 and exposed from the socket housing 15 (see FIG. 1) in order to lock the plug connector 2.

Figure 3:
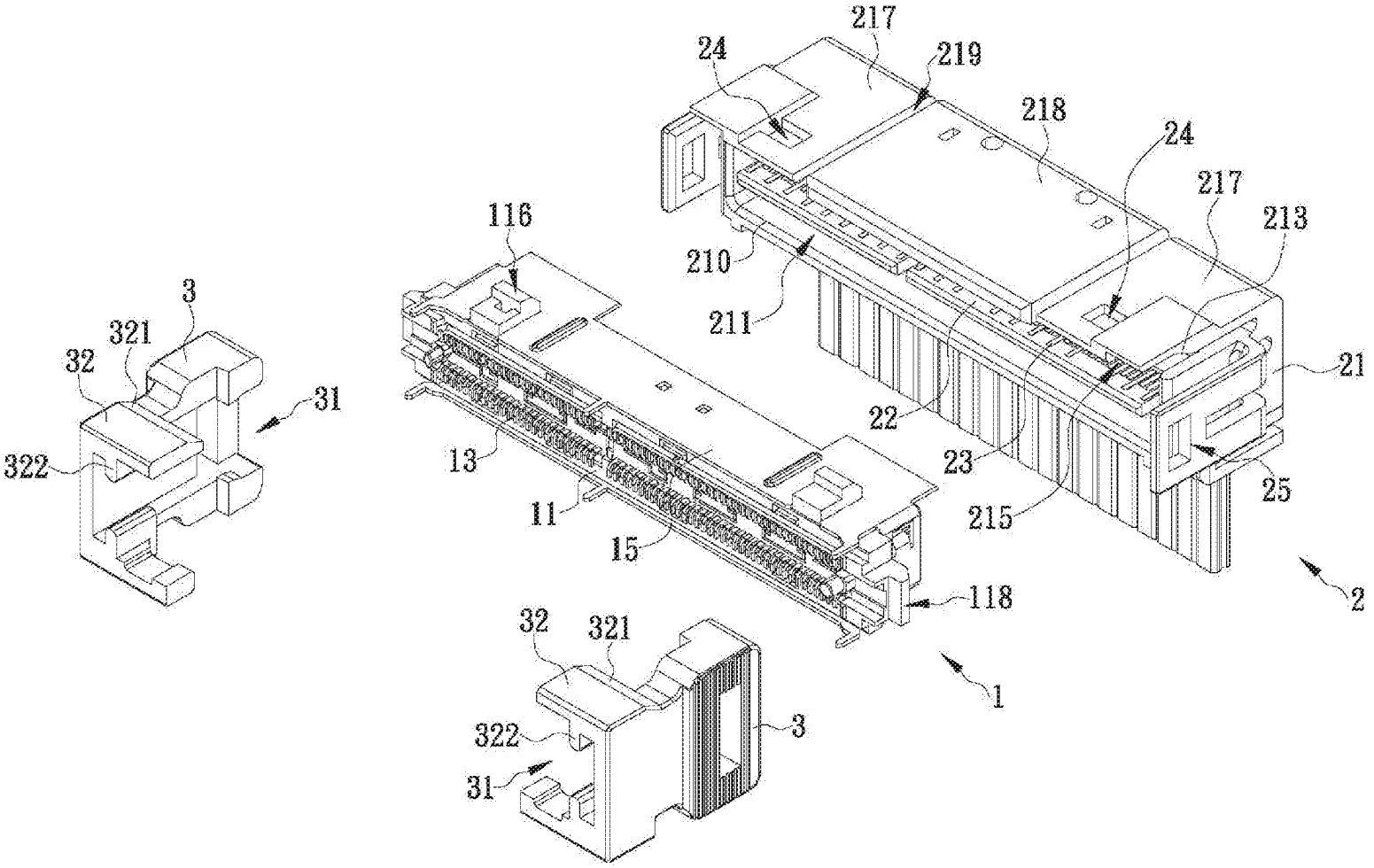
FIG. 3 shows the plug connector assembly and the socket connector in FIG. 1 from another viewing angle.
Figure 4:
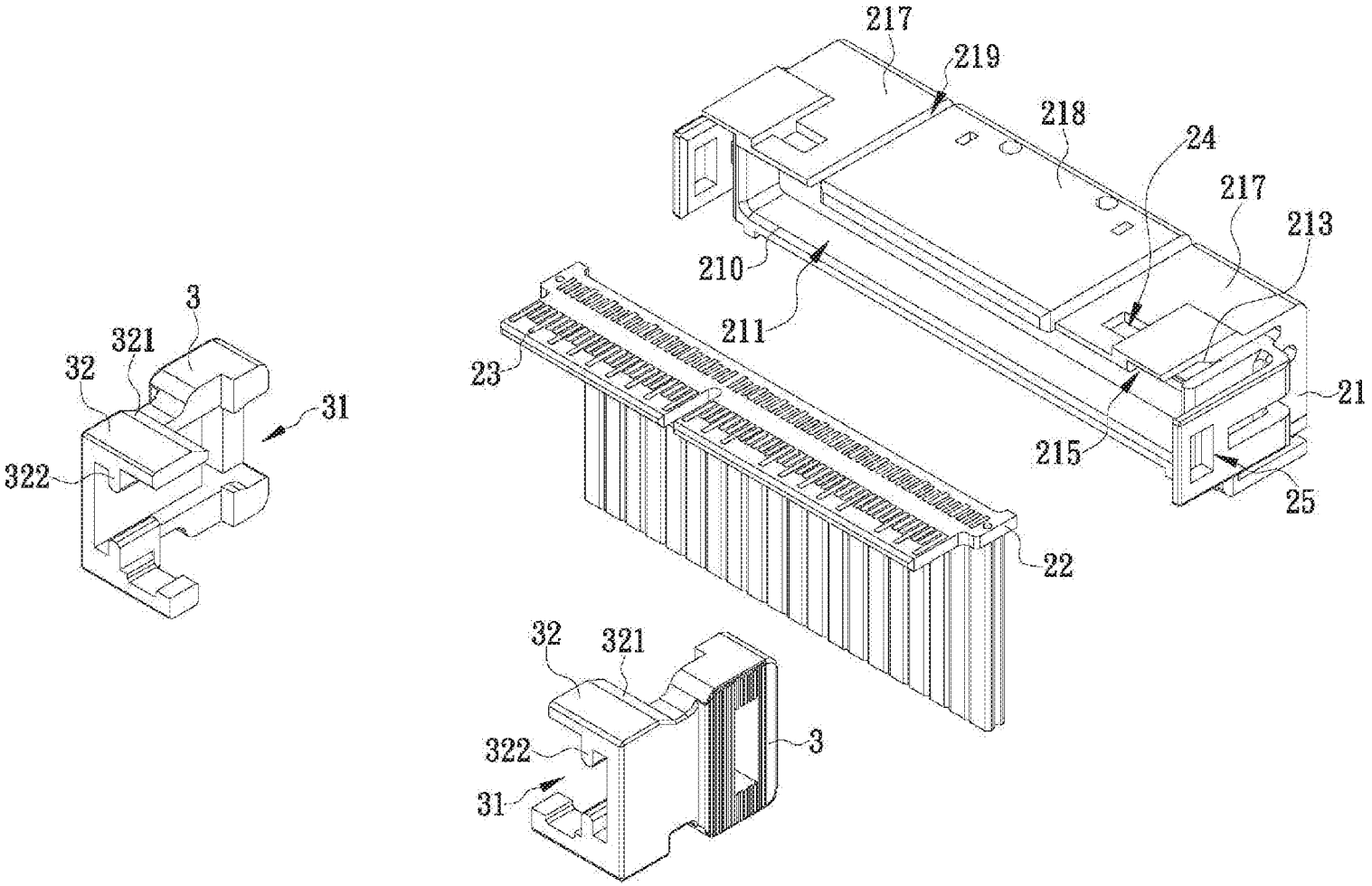
FIG. 4 is an exploded perspective view of the plug connector assembly in FIG. 1.

Referring to FIG. 3 and FIG. 4, the plug connector 2 in this embodiment is composed at least of a plug housing 21, an insulating plug body 22, and a plurality of metal plug terminals 23. The bottom side of the plug housing 21 is formed with a plug insertion opening 210, the plug insertion opening 210 is recessed into the plug housing to form a plug assembly space 211 extending into the plug housing 21 from the plug insertion opening 210, and the plug assembly space 211 is adapted for accommodating the insulating plug body 22. The rear surface of the plug housing 21 is provided with two first locking units 24 adjacent to the plug insertion opening 210. Each first locking unit 24 has an opening. When the plug connector 2 is connected to the socket connector 1, the two engaging portions 116 of the socket connector 1 are engaged with the first locking units 24 respectively to form the first locking structure. The left and right surfaces of the plug housing 21 are each provided with a second locking unit 25 that extends outward in a bent configuration. Each second locking unit 25 also has an opening. When the plug connector 2 is connected to the socket connector 1, the two fastening portions 118 of the socket connector 1 are fastened to the second locking units 25 respectively to form the second locking structure. In other embodiments of the present disclosure, the first and the second locking units 24 and 25, the engaging portions 116, and the fastening portions 118 may be adjusted in configuration, or the first locking units 24 and the engaging portions 116 may exist without the second locking units 25 and the fastening portions 118, depending on product requirements.

With continued reference to FIG. 3 and FIG. 4, the metal plug terminals 23 are arranged on the insulating plug body 22. In this embodiment, and by way of example only, the insulating plug body 22 is in the form of a tongue plate, and each metal plug terminal 23 has one end configured as a gold finger and the opposite end configured as a lead. In other embodiments of the present disclosure, the insulating plug body 22 and the metal plug terminals 23 may be adjusted in configuration according to product requirements and the configuration of the socket connector 1. The insulating plug body 22 is configured to be mounted and fixed in the plug assembly space 211 such that the gold finger end of each metal plug terminal 23 is exposed through the plug assembly space 211. When the plug connector 2 is connected to the socket connector 1, each metal plug terminal 23 of the plug connector 2 has its gold finger end inserted into the socket receiving space 111 through the socket insertion opening 110 and electrically connected to the exposed end of the corresponding metal socket terminal 13 to enable an exchange of signals or electric current between the connectors. Moreover, when the plug connector 2 is connected to the socket connector 1, referring to FIG. 5 and FIG. 6, each engaging portion 116 is engaged with the corresponding first locking unit 24 of the plug connector 2 to form the first locking structure, and each fastening portion 118 is fastened to the corresponding second locking unit 25 of the plug connector 2 to form the second locking structure.

Figure 5:
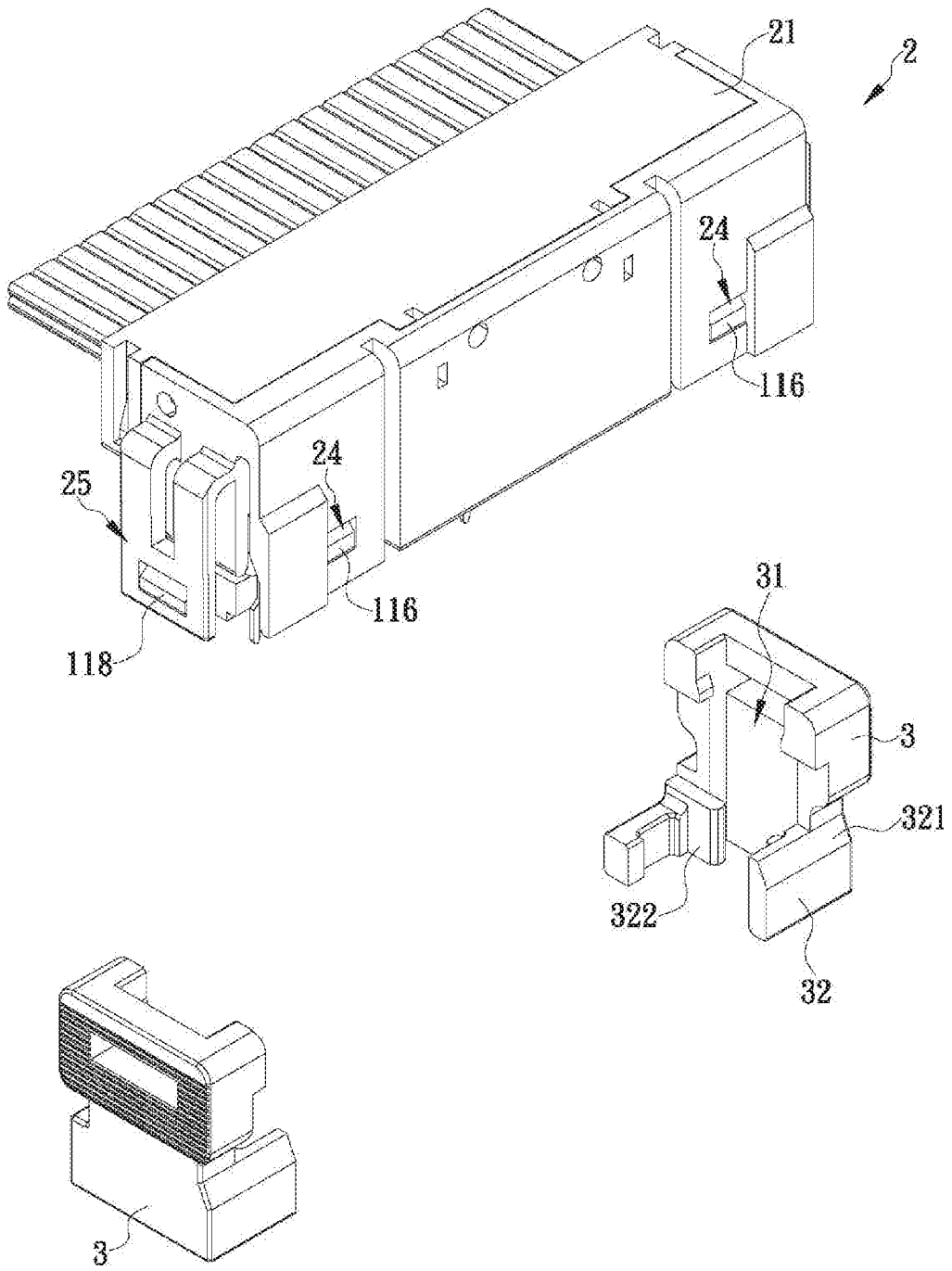
FIG. 5 shows the plug connector d the socket connector in FIG. 1 coupled together.
Figure 6:
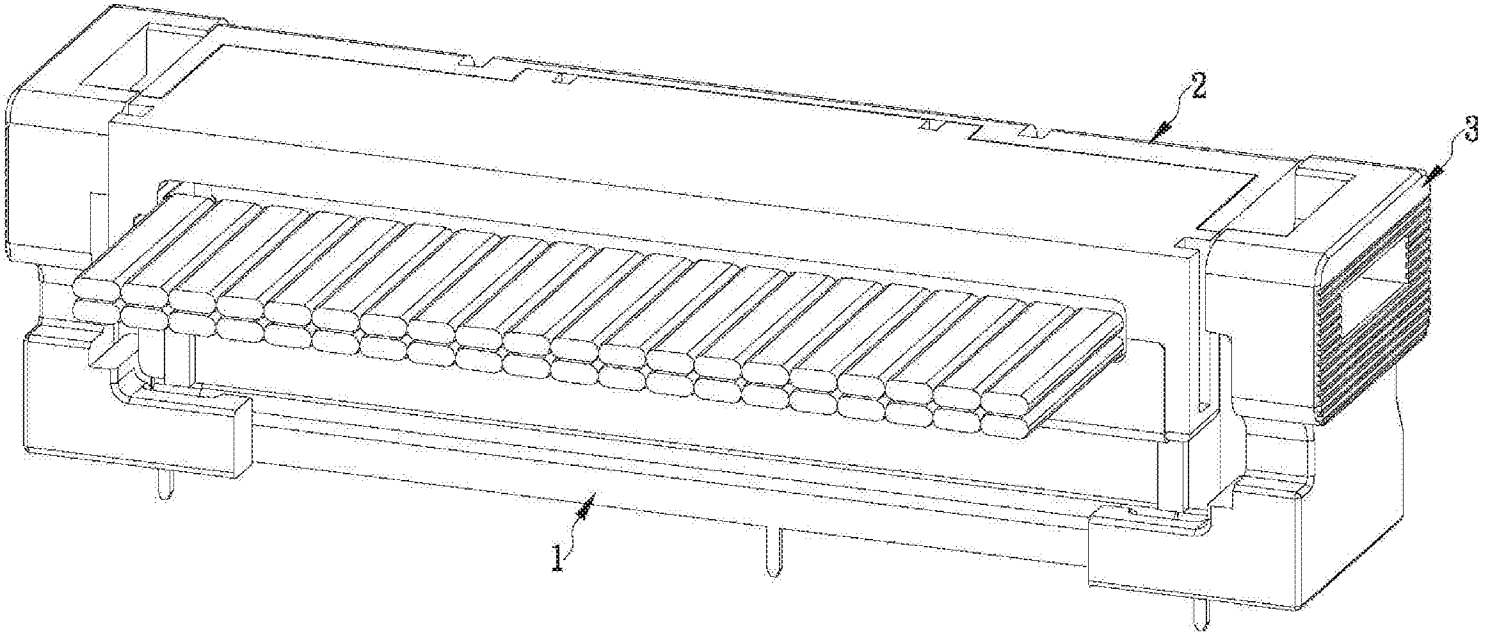
FIG. 6 shows the plug connector assembly and the socket connector in FIG. 1 coupled together.

Referring to FIG. 4 and FIG. 5, the two slidable locking portions 3 are configured to be engaged with the left and right surfaces of the plug connector 2 respectively and thereby cover the second locking units 25 respectively (i.e., in cases where the second locking units 25 are present, each of the two slidable locking portions 3 is engaged with the outer side of the corresponding one of the two second locking units 25). In this embodiment, each slidable locking portion 3 is provided therein with a slide groove 31 that extends downward from the top side of the slidable locking portion 3. The slide grooves 31 match the second locking units 25 in configuration so that, once the connectors 1 and 2 are connected together, the slidable locking portions 3 can be engaged respectively with the left and right surfaces of the connectors 1 and 2 in an upward direction, with each second locking unit 25 and the corresponding fastening portion 118 received in one of the slide grooves 31. Thus, by adjusting the width of the slide grooves 31, the slidable locking portions 3 are enabled not only to be positioned on the second locking units 25 respectively, but also to further secure each second locking unit 25 and the corresponding fastening portion 118 together, ensuring that the connectors 1 and 2 are firmly coupled to each other. When the connectors 1 and 2 and the slidable locking portions 3 are used as automotive connectors, therefore, the double locking structures and the slidable locking portions 3 can keep the connectors 1 and 2 securely coupled together despite vibrations generated by a bumpy road.

Referring back to FIG. 3, the inner wall of the plug housing 21 is provided with two first inclined contact surfaces 213 that are respectively adjacent to the first locking units 24. The first inclined contact surfaces 213 correspond respectively to two slidable locking portions 3 and are adapted for the slidable locking portions 3 to move thereon. The first inclined contact surfaces 213 are movable outward to disengage the first locking units 24 from the engaging portions 116 and bring the first locking units 24 into an unlocked state. In this embodiment, the inner wall of the plug housing 21 is also formed with two recessed portions 215 corresponding respectively to the first inclined contact surfaces 213, and the recessed portions 215 define accommodating spaces that are in communication with the plug insertion opening 210. Moreover, each slidable locking portion 3 is provided with an extension arm 32 corresponding in position to one of the recessed portions 215 and to be respectively accommodated in the accommodating spaces. When the slidable locking portions 3 are engaged with the left and right surfaces of the plug connector 2 respectively, each extension arm 32 extends into the corresponding recessed portion 215 through the plug insertion opening 210 (see FIG. 7). That is, when the slidable locking portions are engaged with the left surface and the right surface of the plug connector 2 respectively, the extension arm 32 enters into a corresponding one of the accommodating spaces through the plug insertion opening 210 and is accommodated in the corresponding accommodating space.

Figure 7:
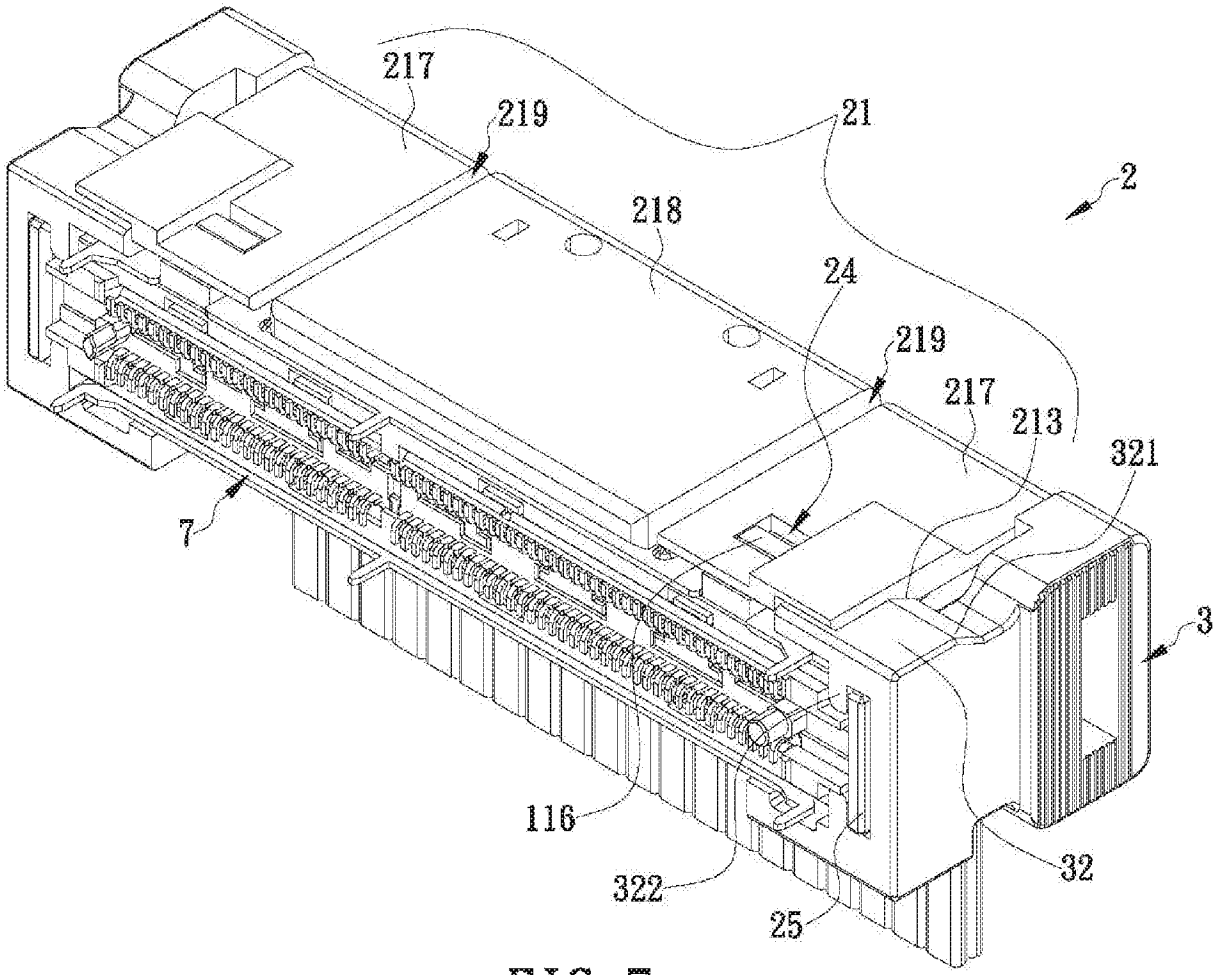
FIG. 7 shows the plug connector assembly and the socket connector in FIG. 6 from another viewing angle.
Figure 8:
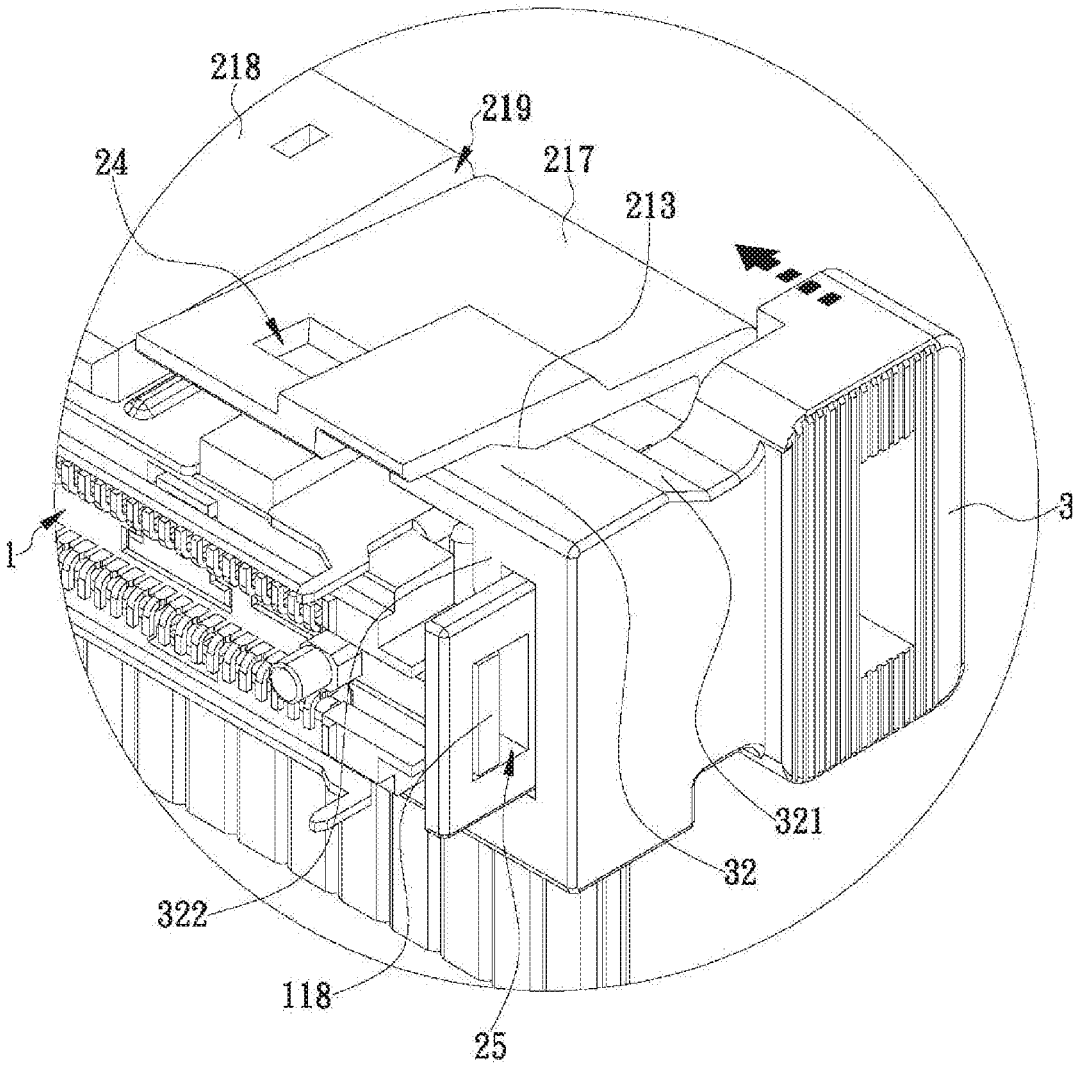
FIG. 8 is a partial enlarged view of the plug connector assembly and the socket connector in FIG. 7.

The unlocking procedure of the present disclosure is as follows. Referring to FIG. 3, FIG. 7, and FIG. 8, the two slidable locking portions 3 are moved toward the top side of the plug housing 21 such that each slidable locking portion 3 is moved along the corresponding first inclined contact surface 213 to push the rear surface of the plug housing 21 outward (see FIG. 8). As a result, each first locking unit 24 is disengaged from the corresponding engaging portions 116, and the connectors 1 and 2 are brought into the first unlocked state. In this embodiment, each extension arm 32 is provided with a second inclined contact surface 321, and when the slidable locking portions 3 are moved toward the top side of the plug housing 21, the second inclined contact surfaces 321 will be pressed against and moved along the first inclined contact surfaces 213 respectively, making it easier for the slidable locking portions 3 to push the rear surface of the plug housing 21 outward. In other embodiments of the present disclosure, the plug housing 21 and the slidable locking portions 3 may be adjusted in configuration according to product requirements and dispense with the recessed portions 215, the extension arms 32, and the second inclined contact surfaces 321, provided that the two slidable locking portions 3 can be moved along the first inclined contact surfaces 213 respectively to push the rear surface of the plug housing 21 outward and thereby disengage, or unlock, each first locking unit 24 from the corresponding engaging portion 116.

Apart from the configurations described above, the present disclosure can be implemented in such a way that, referring to FIG. 7 and FIG. 8, the first inclined contact surfaces 213 are dispensed with while the second inclined contact surfaces 321 of the two slidable locking portions 3 remain. For example, the plug housing 21 may be reduced in length such that the second inclined contact surfaces 321 of the two slidable locking portions 3 are exposed and, when the slidable locking portions 3 are moved toward the top side of the plug housing 21, are inserted into the plug housing 21 to push the rear surface of the plug housing 21 outward and thereby unlock the first locking units 24.

As the rear surface of the plug housing 21 can be pushed outward only to a limited extent when configured as a one-piece structure, one way to achieve a greater pushing distance is to form the rear surface of the plug housing 21 into two movable plates 217 and a main plate 218 as shown in FIG. 3, FIG. 7, and FIG. 8. The two movable plates 217 are located on two lateral sides of the main plate 218 respectively and each have one of the first locking units 24 and one of the first inclined contact surfaces 213. In addition, each movable plate 217 is separated from the main plate 218 by a gap 219 (whose length and width may be adjusted according to practical needs) so that the two movable plates 217 can be pushed outward to a greater extent when the slidable locking portions 3 are moved toward the top side of the plug housing 21, making it easier to disengage the first locking units 24 from the engaging portion 116 respectively and thereby bring the connectors 1 and 2 into the first unlocked state. In other embodiments of the present disclosure, the movable plates 217 may be made thinner than the main plate 218 while the gaps 219 are eliminated, the rationale being that the two relatively thin movable plates 217 will be respectively deformed to a greater extent by the slidable locking portions 3 than when having the same thickness as the main plate 218, and that the larger deformation helps bring the connectors 1 and 2 into the first unlocked state with greater ease.

With continued reference to FIG. 3, FIG. 7, and FIG. 8, the inner wall of each second locking unit 25 is spaced apart from the left or right surface of the plug housing 21, and each of the second locking units 25 is movable along a direction away from the corresponding left surface or right surface of the plug housing 21. When the two slidable locking portions 3 are moved toward the top side of the plug housing 21 to such an extent that the top sides of the two slidable locking portions 3 have moved beyond the top side of the plug housing 21 (see FIG. 8), that is, the two slidable locking portions 3 are located at positions where top sides of the two slidable locking portions 3 protrude beyond the top side of the plug housing 21, the areas of the two slidable locking portions 3 that are respectively adjacent to the top sides of the slidable locking portions 3 can be pressed toward, and hence brought close to, each other (as indicated by the dashed-line arrow in FIG. 8) so that the second locking units 25 are respectively pushed by the areas of the two slidable locking portions 3 that are respectively adjacent to the bottom sides of the slidable locking portions 3, and are therefore disengaged from the fastening portions 118 respectively, bringing the connectors 1 and 2 into the second unlocked state; that is, when the two slidable locking portions 3 are pressed at areas of the two slidable locking portions 3 that are respectively adjacent to the top sides of the slidable locking portions 3, each of the second locking units 25 move along a direction away from the corresponding left surface or right surface of the plug housing 21, and disengage from the corresponding fastening portion 118 and enter into an unlocking state by being pushed respectively by a corresponding one of areas of the two slidable locking portions 3 that are respectively adjacent to bottom sides of the slidable locking portions 3. More specifically, each extension arm 32 in this embodiment is protrudingly provided with a pushing portion 322. When the slidable locking portions 3 are engaged with the left and right surfaces of the plug connector 2 (or more particularly the plug housing 21) respectively, each pushing portion 322 extends into the space between the inner wall of the corresponding second locking unit 25 and the left or right surface of the plug housing 21. When the slidable locking portions 3 are subsequently moved toward the top side of the plug housing 21 and the areas more particularly the outer surface areas) of the slidable locking portions 3 that are respectively adjacent to the top sides of the slidable locking portions 3 are pressed toward each other, each pushing portion 322 will push the corresponding second locking unit 25 outward away from the corresponding fastening portion 118. That is, the pushing portion 322 protrudes into a space between an inner wall of a corresponding one of the second locking units 25 and a corresponding one of the left surface and the right surface of the plug housing 21 when the slidable locking portions 3 are engaged with the left surface and the right surface of the plug connector 2 respectively, and pushes the corresponding one of the second locking units 25 when the slidable locking portions 3 are engaged with the left surface and the right surface of the plug connector 2 respectively, and the areas of the two slidable locking portions 3 that are respectively adjacent to the top sides of the slidable locking portions 3 are pressed.

In this embodiment, referring back to FIG. 1 and FIG. 2, the top end of each engaging portion 116 juts out of the rear surface of the socket body portion 11A and forms a first shoulder 117. When the insulating socket body 11 is mounted into the socket housing 15, the engaging portions 116 extend respectively into the engaging holes 151 of the socket housing 15 until each first shoulder 117 is pressed against the wall of the corresponding engaging hole 151. Once the connectors 1 and 2 are connected together, therefore, pulling the plug connector 2 away from the socket connector 1 will not separate the insulating socket body 11 from the socket housing 15 because, although subjected to an upwardly displacing force generated by the plug connector 2, the insulating socket body 11 is blocked by cooperation between the first shoulders 117 and the engaging holes 151 to preserve the structural integrity of the socket connector 1. In addition, the top end of each engaging portion 116 is provided with a first inclined guide surface 1161 so that each engaging portion 116 can extend into and be engaged in the opening of the corresponding first locking unit 24 with ease. Similarly, the top end of each fastening portion 118 may be provided with a second inclined guide surface 1181 so that each fastening portion 118 can extend into and be engaged in the opening of the corresponding second locking unit 25 with ease.

To further secure the socket housing 15 and the insulating socket body 11 in the connected state, referring again to FIG. 1 and FIG. 2, the left and right surfaces of the socket body portion 11A are each provided with a groove 115 extending downward from a top edge of the socket body portion 11A, and the left and right surfaces of the socket housing 15 are each provided with an engaging plate 153 protruding toward the socket assembly space 150. When the insulating socket body 11 is inserted upward into the socket assembly space 150, each engaging plate 153 extends into, and presses against the wall of, the corresponding groove 115. Once the connectors 1 and 2 are connected together, therefore, pulling the plug connector 2 away from the socket connector 1 will not separate the insulating socket body 11 from the socket housing 15 because, although subjected to an upwardly displacing force generated by the plug connector 2, the insulating socket body 11 is blocked by the engaging plates 153.

While the present disclosure herein disclosed has been described by means of specific embodiments, numerous modifications and variations could be made thereto by those skilled in the art without departing from the scope of the present disclosure set forth in the claims.

What is claimed is:

1. A plug connector, comprising:

an insulating plug body provided with a plurality of metal plug terminals; and a plug housing having:

a plug insertion opening formed on a bottom side of the plug housing and recessed into the plug housing to form a plug assembly space in the plug housing, wherein the plug assembly space is adapted for accommodating the insulating plug body;

two first locking units provided on a rear surface of the plug housing, adjacent to the plug insertion opening, and configured to be respectively engaged with two engaging portions of a socket connector when the plug connector and the socket connector are connected together; and a movable unlocking structure, including two inclined contact surfaces on an inner wall of the plug housing, adjacent to the first locking units respectively, corresponding respectively to two slidable locking portions and adapted for the slidable locking portions to move thereon, and being movable outward to disengage the first locking units from the engaging portions and bring the first locking units into an unlocked state, wherein when the plug connector and the socket connector are connected, a left surface and a right surface of the plug housing are engaged with the slidable locking portions respectively, and the slidable locking portions move toward a top side of the plug housing along the inclined contact surfaces, the rear surface of the plug housing is pushed outward by the slidable locking portions to disengage the first locking units from the engaging portions and bring the first locking units into an unlocked state.

2. The plug connector of claim 1, wherein the rear surface of the plug housing is formed with two movable plates and a main plate located between the two movable plates, and each of the two movable plates is formed with one f the first locking units and one of the inclined contact surfaces and is separated from the main plate by a gap.

3. The plug connector of claim 1, wherein the rear surface of the plug housing is formed with two movable plates and a main plate located between the two movable plates, and each of the two movable plates is formed with one of the first locking units and one of the inclined contact surfaces and has a smaller thickness than the main plate.

4. The plug connector assembly of claim 3, wherein the rear surface of the plug housing is formed with two movable plates and a main plate located between the two movable plates, and each of the two movable plates is formed with one of the first locking units and one of the first inclined contact surfaces and is separated from the main plate by a gap.

5. The plug connector assembly of claim 3, wherein the rear surface of the plug housing is formed with two movable plates and a main plate located between the two movable plates, and each of the two movable plates is formed with one of the first locking units and one of the first inclined contact surfaces, and has a smaller thickness than the main plate.

6. The plug connector of claim 1, wherein the plug housing further has two second locking units provided on the left and the right surfaces of the plug housing respectively, each extending outward in a bent configuration and configured to, when the plug connector and the socket connector are connected, be fastened to a corresponding one of two fastening portions of the socket connector, and be engaged with a corresponding one of the two slidable locking portions through an outer side of the corresponding second locking unit.

7. The plug connector of claim 6, wherein each of the second locking units has an inner wall spaced apart from a corresponding one of the left surface and the right surface of the plug housing, and each of the second locking units is movable along a direction away from the corresponding left surface or right surface of the plug housing, and configured to move along the direction, disengage from the corresponding fastening portion and enter into an unlocking state by being pushed respectively by a corresponding one of areas of the two slidable locking portions that are respectively adjacent to bottom sides of the slidable locking portions when the plug connector and the socket connector are connected and the two slidable locking portions are engaged with the plug housing, located at positions where top sides of the two slidable locking portions protrude beyond the top side of the plug housing, and pressed at areas of the two slidable locking portions that are respectively adjacent to the top sides of the slidable locking portions.

8. The plug connector of claim 7, wherein the rear surface of the plug housing is formed with two movable plates and a main plate located between the two movable plates, and each of the two movable plates is formed with one of the first locking units and one of the inclined contact surfaces and is separated from the main plate by a gap.

9. The plug connector assembly of claim 8, wherein the rear surface of the plug housing is formed with two movable plates and a main plate located between the two movable plates, and each of the two movable plates is formed with one of the first locking units and one of the first inclined contact surfaces and is separated from the main plate by a gap.

10. The plug connector assembly of claim 8, wherein the rear surface of the plug housing is formed with two movable plates and a main plate located between the two movable plates, and each of the two movable plates is formed with one of the first locking units and one of the first inclined contact surfaces, and has a smaller thickness than the main plate.

11. The plug connector of claim 7, wherein the rear surface of the plug housing is formed with two movable plates and a main plate located between the two movable plates, and each of the two movable plates is formed with one of the first locking units and one of the inclined contact surfaces and has a smaller thickness than the main plate.

12. The plug connector assembly of claim 11, wherein the rear surface of the plug housing is formed with two movable plates and a main plate located between the two movable plates, and each of the two movable plates is formed with one of the first locking units and one of the first inclined contact surfaces and is separated from the main plate by a gap.

13. The plug connector assembly of claim 11, wherein the rear surface of the plug housing is formed with two movable plates and a main plate located between the two movable plates, and each of the two movable plates is formed with one of the first locking units and one of the first inclined contact surfaces, and has a smaller thickness than the main plate.

14. The plug connector of claim 6, wherein the rear surface of the plug housing is formed with two movable plates and a main plate located between the two movable plates, and each of the two movable plates is formed with one of the first locking units and one of the inclined contact surfaces and is separated from the main plate by a gap.

15. The plug connector of claim 6, wherein the rear surface of the plug housing is formed with two movable plates and a main plate located between the two movable plates, and each of the two movable plates is formed with one of the first locking units and one of the inclined contact surfaces and has a smaller thickness than the main plate.

16. The plug connector assembly of claim 15, wherein the rear surface of the plug housing is formed with two movable plates and a main plate located between the two movable plates, and each of the two movable plates is formed with one of the first locking units and one of the first inclined contact surfaces and is separated from the main plate by a gap.

17. The plug connector assembly of claim 15, wherein the rear surface of the plug housing is formed with two movable plates and a main plate located between the two movable plates, and each of the two movable plates is formed with one of the first locking units and one of the first inclined contact surfaces, and has a smaller thickness than the main plate.

18. A plug connector assembly, comprising:

a plug connector having:

an insulating plug body provided with a plurality of metal plug terminals;

a plug housing having:

a plug insertion opening formed on a bottom side of the plug housing and recessed into the plug housing to form a plug assembly space in the plug housing, wherein the plug assembly space is adapted for accommodating the insulating plug body; and two first locking units provided on a rear surface of the plug housing, adjacent to the plug insertion opening, and configured to be respectively engaged with two engaging portions of a socket connector when the plug connector and the socket connector are connected together; and a movable unlocking structure comprising two slidable locking portions, wherein at least one of the plug housing and the two slidable locking portions has two first inclined contact surfaces, and the two slidable locking portions are configured to:

engage a left surface and a right surface of the plug housing respectively;

push the rear surface of the plug housing outward via the first inclined contact surfaces to separate the first locking units from the engaging portions respectively and bring the first locking units into an unlocked state when the plug connector and the socket connector are connected and the two slidable locking portions are engaged with the plug housing and move toward a top side of the plug housing.

19. The plug connector assembly of claim 18, wherein the rear surface of the plug housing is formed with two movable plates and a main plate located between the two movable plates, and each of the two movable plates is formed with one of the first locking units and one of the first inclined contact surfaces and is separated from the main plate by a gap.

20. The plug connector assembly of claim 18, wherein the rear surface of the plug housing is formed with two movable plates and a main plate located between the two movable plates, and each of the two movable plates is formed with one of the first locking units and one of the first inclined contact surfaces, and has a smaller thickness than the main plate.

21. The plug connector assembly of claim 18, wherein the plug housing has an inner wall provided with the two first inclined contact surfaces, the two inclined contact surfaces are adjacent to the first locking units respectively, and the slidable locking portions are configured to push the rear surface of the plug housing outward by moving respectively along the inclined contact surfaces when the plug connector and the socket connector are connected and the two slidable locking portions are engaged with the plug housing and move toward the top side of the plug housing.

22. The plug connector assembly of claim 21, wherein the plug housing further has two second locking units provided on the left and the right surfaces of the plug housing respectively, each extending outward in a bent configuration and configured to, when the plug connector and the socket connector are connected, be fastened to a corresponding one of two fastening portions of the socket connector, and be engaged with a corresponding one of the two slidable locking portions through an outer side of the second locking unit.

23. The plug connector assembly of claim 22, wherein each of the second locking units has an inner wall spaced apart from a corresponding one of the left surface and the right surface of the plug housing, and each of the second locking units is movable along a direction away from the corresponding left surface or right surface of the plug housing, and configured to move along the direction, disengage from the corresponding fastening portion and enter into an unlocking state by being pushed respectively by a corresponding one of areas of the two slidable locking portions that are respectively adjacent to bottom sides of the slidable locking portions when the plug connector and the socket connector are connected and the two slidable locking portions are engaged with the plug housing, located at positions where top sides of the two slidable locking portions protrude beyond the top side of the plug housing, and pressed at areas of the two slidable locking portions that are respectively adjacent to the top sides of the slidable locking portions.

24. The plug connector assembly of claim 23, wherein each of the slidable locking portions has an extension arm, the inner wall of the plug housing is formed with two recessed portions corresponding respectively to the first inclined contact surfaces and defining accommodating spaces for accommodating the extension arms respectively that are in communication with the plug insertion opening, the extension arm corresponds in position to one of the recessed portions, and when the slidable locking portions are engaged with the left surface and the right surface of the plug connector respectively, the extension arm enters into a corresponding one of the accommodating spaces through the plug insertion opening and is accommodated in the corresponding accommodating space.

25. The plug connector assembly of claim 24, wherein the extension arm has a second inclined contact surface, and when the slidable locking portions are engaged with the plug connector and move toward the top side of the plug housing, the second inclined contact surface is pressed against and moved along a corresponding one of the first inclined contact surfaces.

26. The plug connector assembly of claim 25, wherein the extension arm is protrudingly formed with a pushing portion protruding into a space between an inner wall of a corresponding one of the second locking units and a corresponding one of the left surface and the right surface of the plug housing when the slidable locking portions are engaged with the left surface and the right surface of the plug connector respectively, and configured to push the corresponding one of the second locking units when the slidable locking portions are engaged with the left surface and the right surface of the plug connector respectively and the areas of the two slidable locking portions that are respectively adjacent to the top sides of the slidable locking portions are pressed.

27. The plug connector assembly of claim 22, wherein the rear surface of the plug housing is formed with two movable plates and a main plate located between the two movable plates, and each of the two movable plates is formed with one of the first locking units and one of the first inclined contact surfaces and is separated from the main plate by a gap.

28. The plug connector assembly of claim 22, wherein the rear surface of the plug housing is formed with two movable plates and a main plate located between the two movable plates, and each of the two movable plates is formed with one of the first locking units and one of the first inclined contact surfaces, and has a smaller thickness than the main plate.

29. The plug connector assembly of claim 21, wherein the rear surface of the plug housing is formed with two movable plates and a main plate located between the two movable plates, and each of the two movable plates is formed with one of the first locking units and one of the first inclined contact surfaces and is separated from the main plate by a gap.

30. The plug connector assembly of claim 21, wherein the rear surface of the plug housing is formed with two movable plates and a main plate located between the two movable plates, and each of the two movable plates is formed with one of the first locking units and one of the first inclined contact surfaces, and has a smaller thickness than the main plate.

* * * * *